United States Patent [19]

Sales

[11] Patent Number: 4,789,923

[45] **Date of Patent: * Dec. 6, 1988**

[54] REFLECTOR FOR ROADWAY LIGHTING LUMINAIRE

[75] Inventor: Kenneth B. Sales, Radford, Va.

[73] Assignee: Hubbell Incorporated, Orange, Conn.

[ * ] Notice: The portion of the term of this patent subsequent to Sep. 15, 2004 has been disclaimed.

[21] Appl. No.: 95,311

[22] Filed: Sep. 11, 1987

Related U.S. Application Data

[63] Continuation of Ser. No. 945,528, Dec. 23, 1986, Pat. No. 4,694,382.

[51] Int. Cl.[4] ..... F21V 7/00

[52] U.S. Cl. ..... 362/346; 362/347; 362/348; 362/145

[58] Field of Search ..... 362/346, 347, 348, 349, 362/350, 361, 145, 296, 297, 341

[56] References Cited

U.S. PATENT DOCUMENTS

| | | | |
|---|---|---|---|
| 1,199,071 | 9/1916 | Heckert | 362/304 |
| 1,471,166 | 10/1923 | Jones | 362/348 |
| 1,903,417 | 4/1933 | Grant | 362/61 |
| 2,913,570 | 11/1959 | Gough et al. | 240/3 |
| 2,945,945 | 7/1960 | Rex | 240/25 |
| 3,257,553 | 6/1966 | Tolbert | 240/25 |
| 3,283,140 | 11/1966 | Rex | 362/309 |
| 3,662,165 | 5/1972 | Osteen et al. | 240/103 |
| 3,700,883 | 10/1972 | Donohue et al. | 240/41.36 |
| 3,740,545 | 6/1973 | Frankling et al. | 240/25 |
| 3,746,854 | 7/1973 | Brass | 240/41.36 |
| 4,028,542 | 6/1977 | McReynolds, Jr. | 240/41 |
| 4,081,667 | 3/1978 | Lewin et al. | 362/296 |
| 4,242,727 | 12/1980 | deVos et al. | 362/346 |
| 4,347,554 | 8/1982 | Matsushita | 362/297 |
| 4,349,866 | 9/1982 | Molnar | 362/263 |
| 4,351,018 | 9/1982 | Fratty | 362/215 |
| 4,358,816 | 11/1982 | Soileau | 362/346 |
| 4,360,863 | 11/1982 | Barnes et al. | 362/346 |
| 4,398,239 | 8/1983 | deVos et al. | 362/263 |
| 4,507,717 | 3/1985 | Wijbenga | 362/304 |
| 4,694,382 | 9/1987 | Sales | 362/347 |

FOREIGN PATENT DOCUMENTS

| | | |
|---|---|---|
| 976937 | 10/1975 | Canada . |
| 847132 | 10/1939 | France . |

*Primary Examiner*—Samuel Scott
*Assistant Examiner*—Noah Kamen
*Attorney, Agent, or Firm*—Jerry M. Presson; Walter C. Farley

[57] ABSTRACT

A luminaire comprises a reflector having a concave interior surface formed with bands of reflective facets. The bands are organized in groups to provide the desired illumination pattern and enable the reflector to be formed in a simple fashion. The groups of facets are organized in bands which extend arcuately around the interior of the reflector, each facet being oriented to reflect light to a desired luminance center on a roadway surface.

11 Claims, 3 Drawing Sheets

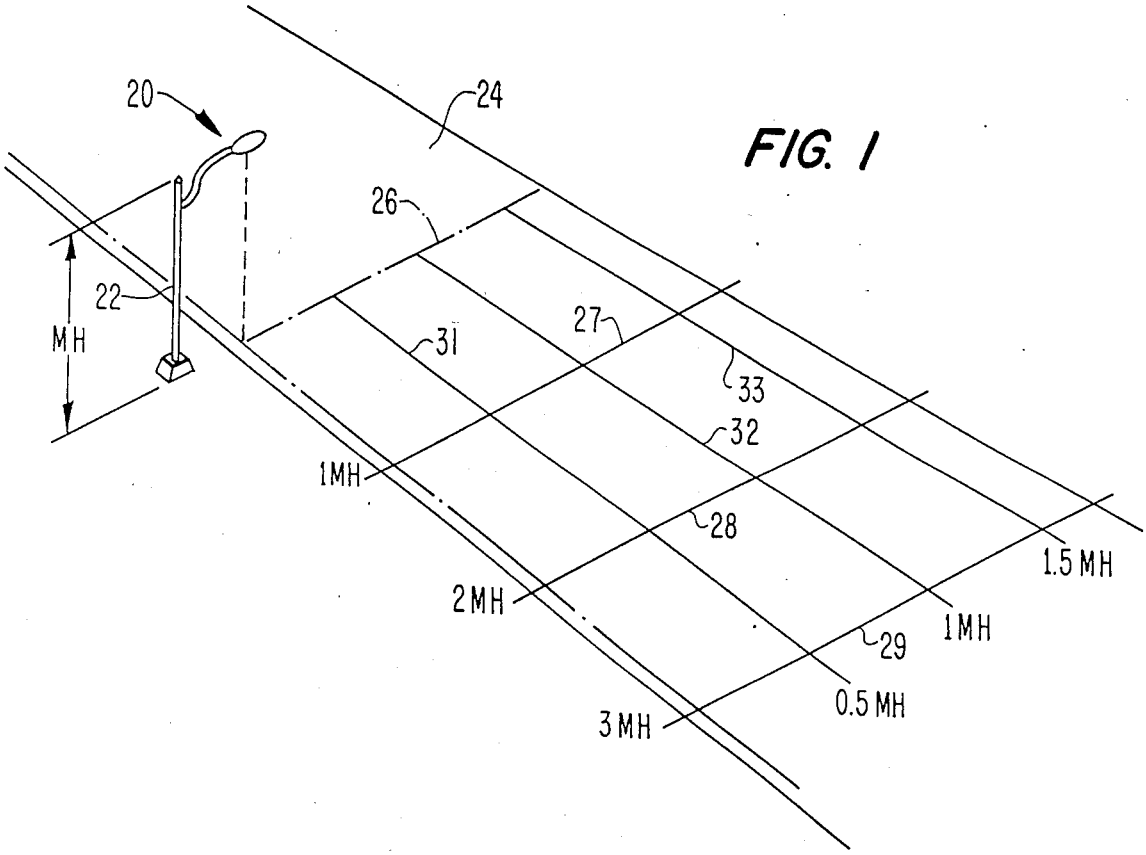
FIG. 1
FIG. 2
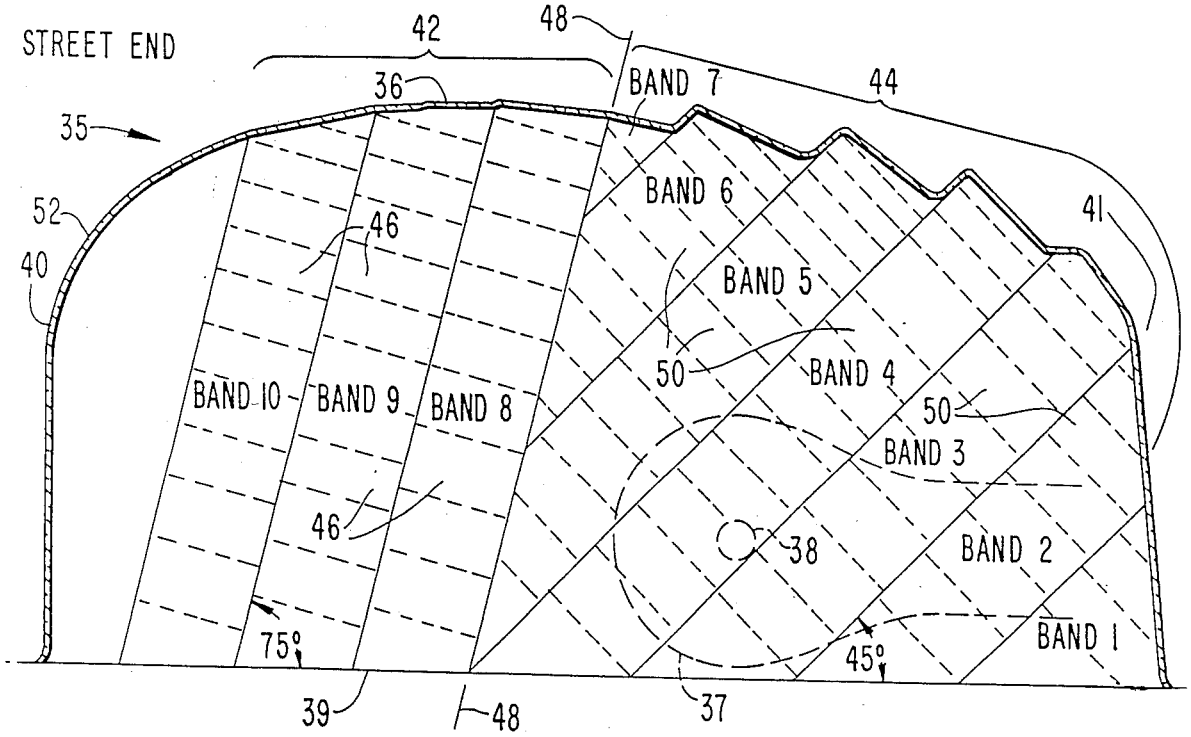

REFLECTOR FOR ROADWAY LIGHTING LUMINAIRE

This is a continuation of application Ser. No. 945,528, filed Dec. 23, 1986, now U.S. Pat. No. 4,694,382.

This invention relates to an improved luminaire reflector and particularly to a reflector designed for improved roadway illumination to produce uniform illumination over a specified area.

BACKGROUND OF THE INVENTION

The primary purpose of roadway lighting is to provide for quick, accurate and comfortable vision at night to make streets and highways useful during the night as well as during the day. Proper and adequate lighting can thus reduce nighttime accidents, aid police protection, facilitate traffic flow and promote business, industry and community well-being in the area. These objectives are described in the publication entitled "American National Standard Practice for Roadway Lighting", published by the Illuminating Engineering Society of North America (1983). It includes the illumination standards known as ANSI/IES RP-8, commonly referred to simply as "RP-8".

In order to achieve these desirable objectives and to be consistent with economic realities and manufacturing capabilities, the luminaires used for roadway lighting should meet the criteria established by RP-8 and the manufacturers of such luminaires must also keep the manufacturing cost to a minimum so that the communities involved can make best use of such lighting facilities. The criteria set forth in RP-8 take into account such factors as the nature of abutting land use, the reflective characteristics of the roadway surface and the kinds of traffic to be expected on the roadway itself. It would be pointless to reiterate the content of the above document herein, and the document is therefore incorporated by reference for all purposes. It should be sufficient, however, to say that uniform lighting of the surface with adequate luminance and maximum spacing between support poles, consistent with the standards of RP-8, is the objective of luminaire design.

Examples of prior art luminaires can be found in the following U.S. patents.

U.S. Pat. No. 3,257,553, Tolbert
U.S. Pat. No. 3,251,987, Wince
U.S. Pat. No. 3,184,199, Clark
U.S. Pat. No. 2,913,570, Gough
U.S. Pat. No. 4,341,018, Fratty
U.S. Pat. No. 1,199,071, Heckert
U.S. Pat. No. 1,471,166, Jones
U.S. Pat. No. 1,903,417, Grant
U.S. Pat. No. 3,740,545, Franklin
U.S. Pat. No. 3,700,883, Donohue
U.S. Pat. No. 4,237,528, Baldwin
U.S. Pat. No. 4,242,727, deVos
U.S. Pat. No. 4,081,667, Lewin
U.S. Pat. No. 4,028,542, McReynolds, Jr.

It will be observed that the illuminating devices in these patents include reflectors and refractors for various purposes in addition to roadway illumination. They are included to demonstrate that a variety of techniques have been employed to obtain certain illumination distribution patterns including the technique of forming facets on the interior of a reflector as well as using optical refractors to cooperate with a reflector to achieve the desired distribution. However, these reflectors have various shortcomings and are not able to accomplish the desired result.

SUMMARY OF THE INVENTION

An object of the present invention is to provide a reflector for a roadway luminaire which achieves an optimum distribution of illuminance and satisfies the recognized needs of roadway luminaires.

A further objective is to provide such a reflector which is relatively inexpensive to manufacture.

A still further object is to provide such a luminaire reflector which needs no optical cover, i.e., no refractive cover which would add to the cost and complexity of the luminaire, in order to achieve the desired luminance distribution.

Briefly described, the invention includes a luminaire for providing a predetermined pattern of illumination of an area such as a portion of a roadway with the luminaire supported above and adjacent to one side edge of the roadway comprising a reflector having an edge defining an elongated bottom opening and a generally concave interior reflective surface, the reflector having a street end oriented toward the roadway to be illuminated and a house end opposite the street end. Means is provided for supporting the reflector with the bottom opening edge lying in a generally horizontal plane at a preselected mounting height MH above the surface of the roadway. A lamp is provided and supported within the reflector with the center of illumination of the lamp closer to the house end than the street end and lying in a longitudinal, central, vertical plane bisecting the interior of the reflector. The interior surface of the reflector includes means defining a plurality of flat reflective facets arranged in an orderly sequence of bands, the surface of each facet lying in a plane forming a predetermined angle relative to the central plane to reflect light from the lamp toward a predetermined location on the roadway surface. The bands form first and second groups of bands, each group including a plurality of bands and each band including a plurality of facets, the groups of bands being disposed on opposite sides of a transverse plane perpendicular to the central vertical plane. Each band in the first group lies toward the street end from the transverse plane and extends arcuately from one side of the bottom edge to the other, the facets in each band of the first group being set at angles to reflect light from the lamp primarily downwardly and generally laterally of the reflector along the roadway. Each band in the second group is toward the house end of the reflector from the transverse plane and lies between planes making angles of about 45°. with the plane containing the bottom edge. Substantially all of the facets of the bands in the second group are set at angles to reflect light from the lamp downwardly and laterally of the reflector and away from the edge of the roadway adjacent the luminaire.

BRIEF DESCRIPTION OF THE DRAWINGS

In order to impart full understanding of the manner in which these and other objectives are attained in accordance with the invention, particularly advantageous embodiments thereof will be described with reference to the accompanying drawings, which form a part of this specification, and wherein:

FIG. 1 is a schematic perspective view of a luminaire in accordance with the invention supported adjacent a roadway to be lighted;

FIG. 2 is a side elevation, in longitudinal section, of a luminaire reflector in accordance with the invention;

DESCRIPTION OF THE PREFERRED EMBODIMENTS

Figure 3:
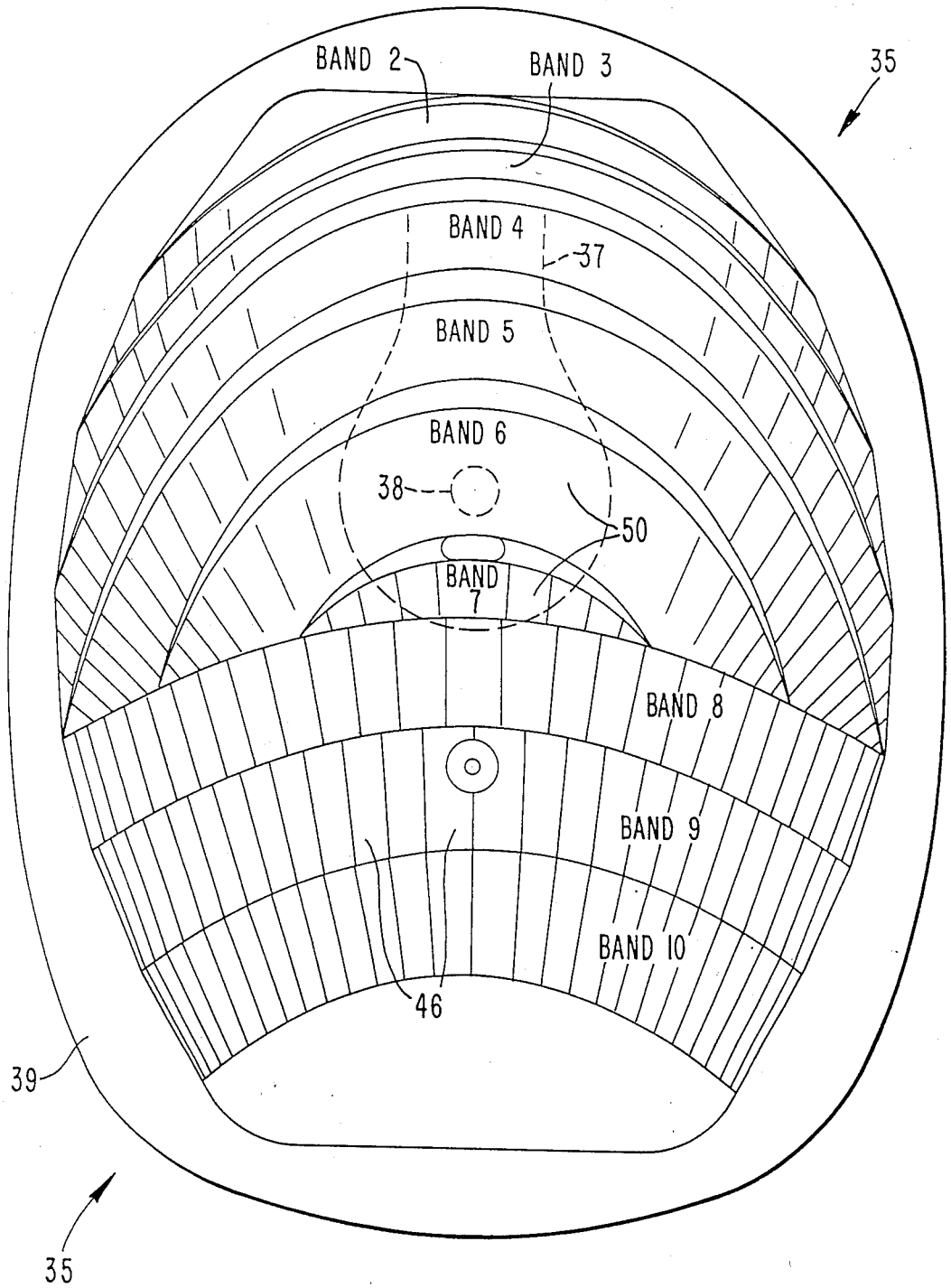
FIG. 3 is a bottom plan view of the reflector of FIG. 2.

FIG. 1 shows a schematic representation of a luminaire indicated generally at 20 which is supported on a pole 22 in a rather conventional fashion, the pole being mounted near the edge of a roadway 24 which is to be illuminated. Luminaire 20 is supported so that the lower side thereof is a distance from the roadway which will be referred to as the mounting height (MH). This mounting height is a measure commonly used to describe and discuss the characteristics of roadway luminaires because the mounting height can be different in different circumstances and with different light sources. However, the distribution pattern is measurable and describable in terms of whole or fractional parts of mounting heights, regardless of the actual dimensions of the mounting height within the design range.

To illustrate this principle, the roadway 24 has been marked in FIG. 1 with a series of lines forming a grid the dimensions of which are in terms of the distance MH. A transverse roadway line 26 is shown extending across the roadway 24 and lies in a plane which contains a perpendicular across the roadway, the luminaire light source and a plumb line between the light source and the roadway which is one MH long. An objective of illumination in an environment of this type is to project light both directions longitudinally along the roadway for some distance as well as toward the opposite edge of the roadway. The distance along the roadway which is adequately lighted by each such luminaire, as well as the shape of the illumination pattern, determines the distance from pole to pole which, for obvious economic reasons, should be as great as possible. In FIG. 1, only the portion extending in one direction from the previously discussed vertical plane is illustrated but it will be understood that a similar grid can be described on the other side of that plane. That plane, in addition, can be regarded as being a central bisector of the luminaire itself.

Thus, the grid includes lines 27, 28 and 29 which are separated from each other by one MH and other lines 31, 32 and 33 which extend longitudinally along the roadway and are separated from each other by 0.5 MH. As will be subsequently described, a grid of this type can be used to describe a luminance pattern produced by the luminaire itself as an indication of the effectiveness of the luminaire to perform its intended task.

In the present invention, the reflector within the luminaire is the element which accomplishes the desired light distribution. The cutoff reflector indicated generally at 35 is illustrated in FIGS. 2 and 3 and includes a metal shell 36 having a generally concave interior surface which is reflective and which is provided with a plurality of specifically directed reflective surface portions. The reflector is adapted to be mounted within a conventional housing, not shown, and supported as generally illustrated in FIG. 1 above the roadway surface, but the housing and supports do not specifically form a part of the present invention. Also, the reflector is designed to contain a lamp therein, the outline of a lamp 37 being shown in FIG. 2. The specific shape of the lamp envelope is not particularly important to the present invention, but the approximate center of illumination of the light source is illustrated at 38. It will be observed that this center of illumination lies in the central bisecting plane previously discussed.

Reflector 35 has a bottom edge 39, street end 40 and a house end 41 which indicate the general orientation of the reflector with respect to the roadway. It will be observed that the center of the light source is significantly closer to the house end of the luminaire than to the street end.

The interior surface of the reflector is divided into a plurality of facets which are organized in a particular fashion to optimize the distribution of luminance and also to permit rather simple manufacture of the reflector.

In particular, the interior surface is formed with two groups of bands of facets, the bands including a first group of bands 42 which lie toward the street end of the reflector and a second group of bands 44 which lie toward the house end thereof. The bands are numbered, beginning at the house end, with band number 1, the last band being band number 10. As will be seen from FIGS. 2 and 3, each of bands 8, 9 and 10 in the first group is arcuate and extends from one side of bottom edge 39 across the inner surface of the reflector to the other side of the bottom edge. Each of these bands lies between planes which are substantially parallel with each other and which form an angle of about 75° with the bottom edge. Furthermore, each of these bands has a plurality of facets 46 which are positioned in predetermined angles with respect to the central bisecting plane.

Groups 42 and 44 are separated from each other by a plane which is transverse and perpendicular to the central vertical plane, the dividing plane lying along the line 48 shown in FIG. 2. The second group of bands 44 includes bands 1–7, each of these bands lying between planes which are substantially parallel with each other and which make an angle of about 45° with the plane containing bottom edge 39. Each of the bands in group 44 includes a plurality of facets 50, these bands also forming arcs extending from one side of the reflector to the other. However, only bands 3 and 4 actually form complete arcs from one side of bottom edge 39 to the other, bands 5, 6 and 7 being interrupted by the dividing plane containing line 48 which forms one side of the first group of bands, and bands 1 and 2 being interrupted by a substantially flat end portion at the house end of the reflector which has an opening through which the mounting arrangement for lamp 37 extends. It will also be noted that the street end of the lamp is not provided with facets but is simply formed with a smooth interior surface 52.

Each facet in each band is formed so that its reflective surface lies in a plane making a predetermined angle with a reference plane, such as the central bisecting plane or the bottom opening plane, the positioning angle of each facet being such that it directs light from source 38 to a specific location, in terms of MH distances, on the roadway surface. More accurately, each such facet is positioned such that the center of the light reflected by that facet passes through a theoretical plae which can be regarded as a flat roadway surface bearing an idealized relationship to the luminaire. An actual roadway surface may, of course, be sloped or curved, but for purposes of evaluating the luminaire itself, a planar surface is used.

Figure 4:
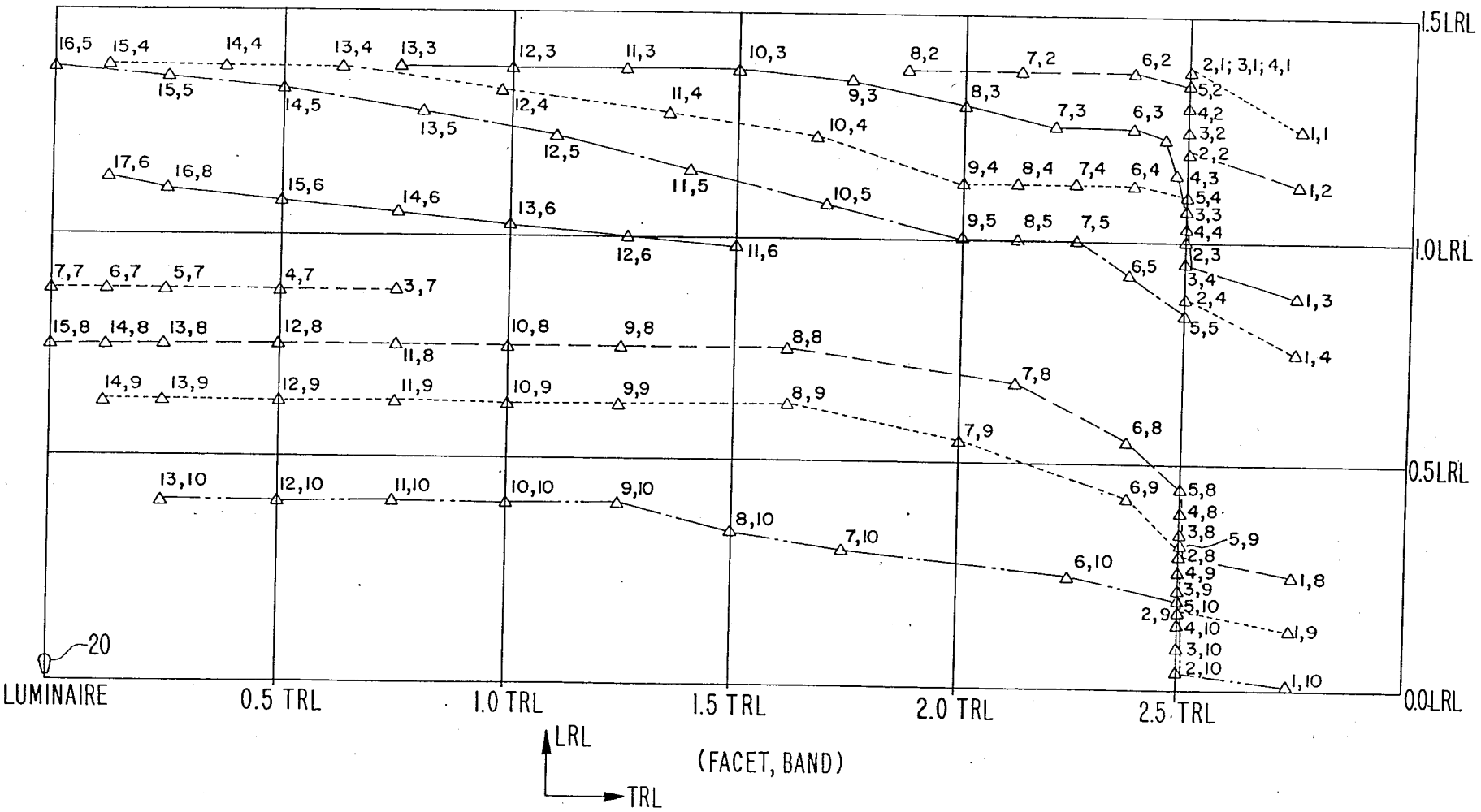
FIG. 4 is a schematic illustration of a portion of roadway illustrating the illumination pattern thereon formed by a reflector in accordance with the invention.

Such a surface is illustrated in FIG. 4 which is a plan view of a grid similar to that discussed in connection with FIG. 1 with each of the measurements in the horizontal and vertical directions being given in terms of the mounting height MH. The luminaire 20 is shown at the lower left-hand corner of the grid, meaning that the grid is regarded as being one-half of the region illuminated by that luminaire.

The vertical and horizontal lines are referred to as transverse roadway lines (TRL) and longitudinal roadway lines (LRL), respectively. Thus, the grid is made up of transverse and longitudinal roadway lines separated from each other by 0.5 MH.

The center of the location illuminated by each facet is identified by a pair of numbers adjacent a triangular symbol. The second number in each pair of numbers represents the band in which the facet is positioned, and the first number represents the sequential number of the facet in that band, the lowest number being adjacent edge 39. It will be recognized that the locations depicted in FIG. 4 result from reflections from the facets in one-half of the reflector, the locations illuminated by reflection from the other half being to the left of the luminaire as seen in FIG. 4. As will be seen, the facets in the first group of bands are set at angles which cause the light reflected from those facets to be primarily downwardly and laterally of the central bisecting plane. The facets in the second group also project light downwardly and laterally but, in addition, distribute the light toward the opposite side of the roadway from that where the luminaire is mounted.

For purposes of clarifying the relationships between the facet positions and the illumination location positions of particular bands, the illumination centers are connected by lines in FIG. 4. It must be emphasized that these lines do not represent isolux lines but are simply provided for the purpose of emphasizing the pattern which is formed by light from the facets. Thus, in the lower portion of FIG. 4, all of the location centers resulting from the facets in band 10 are connected together. It will be recognized that there are 13 facets in band 10 on each side of the central bisecting plane and that the luminance centers are substantially equally spaced apart, as to that band, until the line passes beyond 1.5 TRL. Because of the fact that the illumination farthest from the light source from any one facet is smallest, the lines overlap at about 2.5 TRL and are closer together and are grouped to improve the uniformity of illumination in the areas which are farthest from the luminaire itself. Thus, in the upper right-hand corner of the diagram of FIG. 4, the band lines are closer together as well as overlapping and intersecting to illuminate that farther corner with essentially the same illuminance level as is provided closer to the lamp. The same is true along the 0.5 TRL line near and beyond 1.5 LRL.

The specific reflector shown in FIGS. 2 and 3 is designed to receive a 200–400-watt high pressure sodium (HPS) lamp. In a similar reflector for use with a 50–150-watt lamp, bands 1–7 make an angle of about 40° with the bottom opening plane and bands 8–10 make an angle of about 80° with that plane. It will be observed also that the transition areas between bands are regions of minimum interruption. This permits the reflector to be formed using a mold and a conventional hydraulic forming technique without the difficulties which can arise with very sharp, very complicated or very long transition regions. A substantial manufacturing advantage is thus derived from the arrangement of bands and the angular positioning thereof, as illustrated.

In the specific embodiment illustrated, the facets are intended to be flat and, in the manufactured article, are flat within the tolerances of fabricating with hydroforming processes. It should be noted, however, that some or all of the facets can be made slightly concave or convex to adjust the distribution pattern without overly complicating the manufacturing process.

With a reflector such as that illustrated, using a typical mounting height of 40 feet for a road having a width of 60 feet, a distance of 6 MH between poles is usable under normal roadway conditions. A measure of the efficiency of the illumination provided by such a luminaire is the ratio of the average illumination to the minimum illumination within the pattern. The illustrated reflector achieves a ratio of 3:1 which is somewhat superior to any simple reflector unit and better than most luminaires which use a reflector of some kind in combination with refractive covers. As previously mentioned, the reflector of the present invention does not require any cover except for the purpose of shielding the lamp contained therein. Thus, a simple flat or convex cover can be used for weather protection, no optical characteristics whatsoever being needed to improve the distribution pattern of the luminaire.

While certain advantageous embodiments have been chosen to illustrate the invention, it will be understood by those skilled in the art that various changes and modifications can be made therein without departing from the scope of the invention as defined in the appended claims.

What I claim is:

1. A luminaire for illuminating a predetermined surface area of a roadway having a substantially central longitudinal roadway axis, the roadway having first and second edges defining side edges of the surface area which are substantially equidistant from the roadway axis, the luminaire being elevated above a point adjacent the first one of the side edges of the surface area, the luminaire comprising a reflector having a bottom edge defining an elongated bottom opening having a central longitudinal luminaire axis and a generally concave interior reflective surface bisected by a central, generally vertical, plane containing said longitudinal luminaire axis, said plane and luminaire axis lying substantially perpendicular to said roadway axis opposite said point; and means for mounting a light source within said reflective surface substantially symmetrically with respect to said vertical plane, said interior surface having proximal and distal ends relative to said light source;

said reflective surface being shaped to form a plurality of reflective facets arranged in first and second groups of arcuate bands, each band of each said group having arcuate portions symmetrically disposed on opposite sides of said light source, the bands of said first group of bands (1–7) being adjacent said proximal end and the bands of said second group of bands (8–10) being between said first group and said distal end, the facets of said first group of bands (1–7) having surfaces which are inclined relative to said vertical bisecting plane and to a plane transverse to said bisecting plane so as to direct substantially all of the light received from said light source by the facets of said first group to a first roadway surface area between said longitudinal roadway axis and said second roadway edge, and the facets of said second group of bands (8–10) being inclined relative to the vertical bisecting plane and the transverse plane bisecting said vertical transverse plane to direct substantially all of the light received from said light source by the facets of said second group to a second roadway surface area between said longitudinal roadway axis and said first roadway edge.

2. The luminaire as claimed in claim 1, wherein the facets of said second group of bands which are closest to said bottom edge of said reflector direct light transversely to the most remote points of said second roadway surface area.

3. The luminaire as claimed in claim 1, wherein the facets of said first group of bands and the facets of said second group of bands which are closest to said bottom edge of said reflector direct light transversely to the most remote points of said first and second roadway surface areas, respectively.

4. The luminaire as claimed in claim 1, wherein each group of bands is comprised of a plurality of juxtaposed bands of facets aligned in substantially parallel planes, the planes of said first group of bands and the planes of said second group of bands intersecting said transverse plane at angles of about 45 degrees and 15 degrees, respectively.

5. The luminaire as claimed in claim 4, wherein the facets located most remotely from said bottom of the reflector direct light downwardly to roadway areas which are adjacent said longitudinal axis.

6. The luminaire according to claim 1, wherein the bands of facets of said first and second groups intersect one another at an angle of about 30 degrees.

7. A method of illuminating a roadway surface with a luminaire comprising a generally ovate interior reflective surface having a longitudinal axis and comprised of a plurality of reflective facets, said reflector being symmetrical with respect to a central vertical plane passing through said longitudinal axis, and a light source substantially symmetrical with respect to said longitudinal axis, comprising the steps of, dividing the roadway surface area to be illuminated into a rectangular grid structure comprised of a plurality of grid locations defined by a plurality of equally spaced transverse roadway lines (TRL) and a plurality of equally spaced longitudinal roadway lines (LRL) which intersect said transverse roadway lines (TRL) orthogonally, positioning the luminaire above the grid a mounting height (MH) substantially at coordinates 0.0 TRL, 0.0 LRL with said reflective surface facing the grid and said longitudinal axis substantially perpendicular to LRL, the LRL lines and the TRL lines, respectively, being spaced from each other by a distance equal to about 0.5 MH, orienting a first group of a plurality of reflective facets in said interior surface of the luminaire to form an arcuate band about the light source, the band being inclined relative to a transverse plane passing through the reflective surface, inclining the reflective facets in the first group in at least one plane to direct light to grid locations ranging from between about 0.75 LRL and about 0.5 LRL symmetrically in both directions relative to said central vertical plane without redirection of the light by refraction, orienting a second group of facets in said interior surface of the luminaire to direct light to other grid locations without redirection of the light by refraction.

8. The method according to claim 7 and further comprising the steps of orienting a plurality of the facets of the first group of facets which are closest to the light source to direct light to the grid location defined by the grid line 1.5 TRL.

9. The method according to claim 8, and further comprising the step of orienting the second group of facets to direct light to grid locations ranging between 0.0 LRL and 0.75 LRL.

10. A method of illuminating a generally rectangular surface with a luminaire comprising a generally ovate interior reflector having a longitudinal axis, a plurality of reflective facets and a light source substantially symmetrical with respect to said longitudinal axis, at least one half of said surface being definable by a substantially planar grid structure comprised of a plurality of grid locations defined by a plurality of equally spaced transverse lines (TRL) and a plurality of equally spaced longitudinal lines (LRL) which intersect one another orthogonally, the coordinates of a grid adjacent one side of the surface portion being definable by coordinates 0.0 TRL, 0.0 LRL, the method comprising, positioning the luminaire substantially at the grid coordinates 0.0 TRL, 0.0 LRL and above the grid at a mounting height (MH), positioning the luminaire so that said reflective surface faces said surface portion with said loongitudinal axis substantially perpendicular to line LRL, the lines LRL and TRL being spaced from each other an amount equal to about 0.5 MH, forming a first group of a plurality of light reflecting facets in said interior surface of the luminaire in an arcuate band opposite the light source, inclining the reflective facets in the first group about planes transverse and parallel to said longitudinal axis to direct light to grid locations ranging from between about 0.75 LRL and about 1.5 LRL and inclining a second group of facets in said interior surface of the luminaire to direct light to other grid locations.

11. A luminaire for illuminating a predetermined surface area comprising a reflector having a bottom edge defining an elongated bottom opening having a central longitudinal luminaire axis and a generally concave interior reflective surface bisected by a central, generally vertical, plane containing said longitudinal luminaire axis, and means for mounting a light source within said reflective surface substantially parallel to said vertical plane, said interior surface having proximal and distal ends relative to said light source;

said reflective surface being shaped to form a plurality of reflective facets arranged in first and second groups of arcuate bands, each band of each said group having arcuate portions disposed on opposite sides of said light source, the bands of said first groups of bands (1–7) extending arcuately on said interior surface adjacent said proximal end and the bands of said second group of bands (8–10) extending arcuately on said interior surface between said first group and said distal end, each band of said first group of bands (1–7) having side edges which are inclined relative to a plane transverse to said bisecting plane so as to direct substantially all of the light received from said light source by the facets of said first group to a first roadway surface area between said longitudinal roadway axis and said second roadway edge, and each band of said second group of bands (8–10) having side edges inclined relative to said transverse plane at a different angle from said first group to direct substantially all of the light received from said light source by the facets of said second group to a second roadway surface area between said longitudinal roadway axis and said first roadway edge.

* * * * *